US006276383B1

(12) United States Patent
Galstad

(10) Patent No.: US 6,276,383 B1
(45) Date of Patent: Aug. 21, 2001

(54) BOATLIFT STORAGE NET

(75) Inventor: Bradley M. Galstad, Alexandria, MN (US)

(73) Assignee: Stow-zall, Inc., Alexandria, MN (US)

( * ) Notice: Subject to any disclaimer, the term of this patent is extended or adjusted under 35 U.S.C. 154(b) by 0 days.

(21) Appl. No.: 09/527,550

(22) Filed: Mar. 16, 2000

(51) Int. Cl.[7] ..... E04H 15/00; E04H 15/32

(52) U.S. Cl. ..... 135/120.1; 135/120.3; 135/90; 135/115; 294/77

(58) Field of Search ..... 135/90, 115, 117, 135/119, 120.1, 120.3, 87, 156, 157; 294/74, 75, 77

(56) References Cited

U.S. PATENT DOCUMENTS

| | | | |
|---|---|---|---|
| Re. 33,232 | 6/1990 | Fausett et al. . | |
| 3,011,820 | 12/1961 | Frieder et al. . | |
| 3,546,721 | 12/1970 | Cleary . | |
| 4,664,266 | 5/1987 | Fausett et al. . | |
| 5,622,197 | 4/1997 | Valaire . | |
| 5,692,534 | 12/1997 | Brumfield . | |
| 5,819,341 * | 10/1998 | Simantob | 5/98.1 |
| 5,964,236 * | 10/1999 | Berke | 135/87 |

* cited by examiner

*Primary Examiner*—Beth A. Stephan
(74) *Attorney, Agent, or Firm*—Michael S. Neustel

(57) ABSTRACT

A boatlift storage net for storing a plurality of items under a boatlift canopy. The inventive device includes a support member comprised of a netting material, a perimeter support secured about the outer perimeter of the support member, a pair of corner straps secured to opposing corners of the perimeter support, a plurality of side straps secured to the perimeter support on three sides, and a plurality of male fasteners and female fasteners secured to the side straps and the corner straps. The side straps are positioned about the side members of a canopy frame while the corner straps are secured about the corner arced members within the front end of the boatlift. Various items may be positioned upon the support member out of view and protected from the elements of weather.

19 Claims, 4 Drawing Sheets

BOATLIFT STORAGE NET

BACKGROUND OF THE INVENTION

1. Field of the Invention

The present invention relates generally to storage devices and more specifically it relates to a boatlift storage net for storing a plurality of items under a boatlift canopy.

2. Description of the Prior Art

Boatlifts have been in use for years. Typically, a boatlift is comprised of a plurality of support poles, a canopy frame attached to the support poles, a cover secured to the canopy frame, and a lift structure. It is often desirable for the owner of the boatlift to have a convenient storage area for various items such as life jackets, skiing gear and various other items. However, many recreational lakes do not allow the construction of a storage shed for these items forcing the owner of the boatlift to bring these items with them in their vehicle.

Examples of patented storage devices include U.S. Pat. No. 3,011,820 to Frieder et al.; U.S. Pat. No. 5,622,197 to Valaire; U.S. Pat. No. 33,232 to Fausett et al.; U.S. Pat. No. 4,664,266 to Fausett et al.; U.S. Pat. 3,546,721 to Cleary; U.S. Pat. No. 5,692,534 to Brumfield which are all illustrative of such prior art.

While these devices may be suitable for the particular purpose to which they address, they are not as suitable for storing a plurality of items under a boatlift canopy. Conventional boat lifts do not provide a convenient storage space for items.

In these respects, the boatlift storage net according to the present invention substantially departs from the conventional concepts and designs of the prior art, and in so doing provides an apparatus primarily developed for the purpose of storing a plurality of items under a boatlift canopy.

SUMMARY OF THE INVENTION

In view of the foregoing disadvantages inherent in the known types of storage devices now present in the prior art, the present invention provides a new boatlift storage net construction wherein the same can be utilized for storing a plurality of items under a boatlift canopy.

The general purpose of the present invention, which will be described subsequently in greater detail, is to provide a new boatlift storage net that has many of the advantages of the storage devices mentioned heretofore and many novel features that result in a new boatlift storage net which is not anticipated, rendered obvious, suggested, or even implied by any of the prior art storage devices, either alone or in any combination thereof.

To attain this, the present invention generally comprises a support member comprised of a netting material, a perimeter support secured about the outer perimeter of the support member, a pair of comer straps secured to opposing comers of the perimeter support, a plurality of side straps secured to the perimeter support on three sides, and a plurality of male fasteners and female fasteners secured to the side straps and the comer straps. The side straps are positioned about the side members of a canopy frame while the comer straps are secured about the comer arced members within the front end of the boatlift. Various items may be positioned upon the support member out of view and protected from the elements of weather.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a boatlift storage net that will overcome the shortcomings of the prior art devices.

A second object is to provide a boatlift storage net for storing a plurality of items under a boatlift canopy.

Another object is to provide a boatlift storage net that conveniently storages items within the canopy of a boatlift.

An additional object is to provide a boatlift storage net that can be quickly attached or removed from various sizes and designs of boatlifts.

A further object is to provide a boatlift storage net that keeps items out of a boat that are not needed.

Another object is to provide a boatlift storage net that allows items that are wet to dry quickly thereby preventing mold.

An additional object is to provide a boatlift storage net that stores items in a location free of sun, rain, hail and snow.

A further object is to provide a boatlift storage net that reduces weather damage to items.

Another object is to provide a boatlift storage net that eliminates having to transport items from a boat to a distant storage location.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
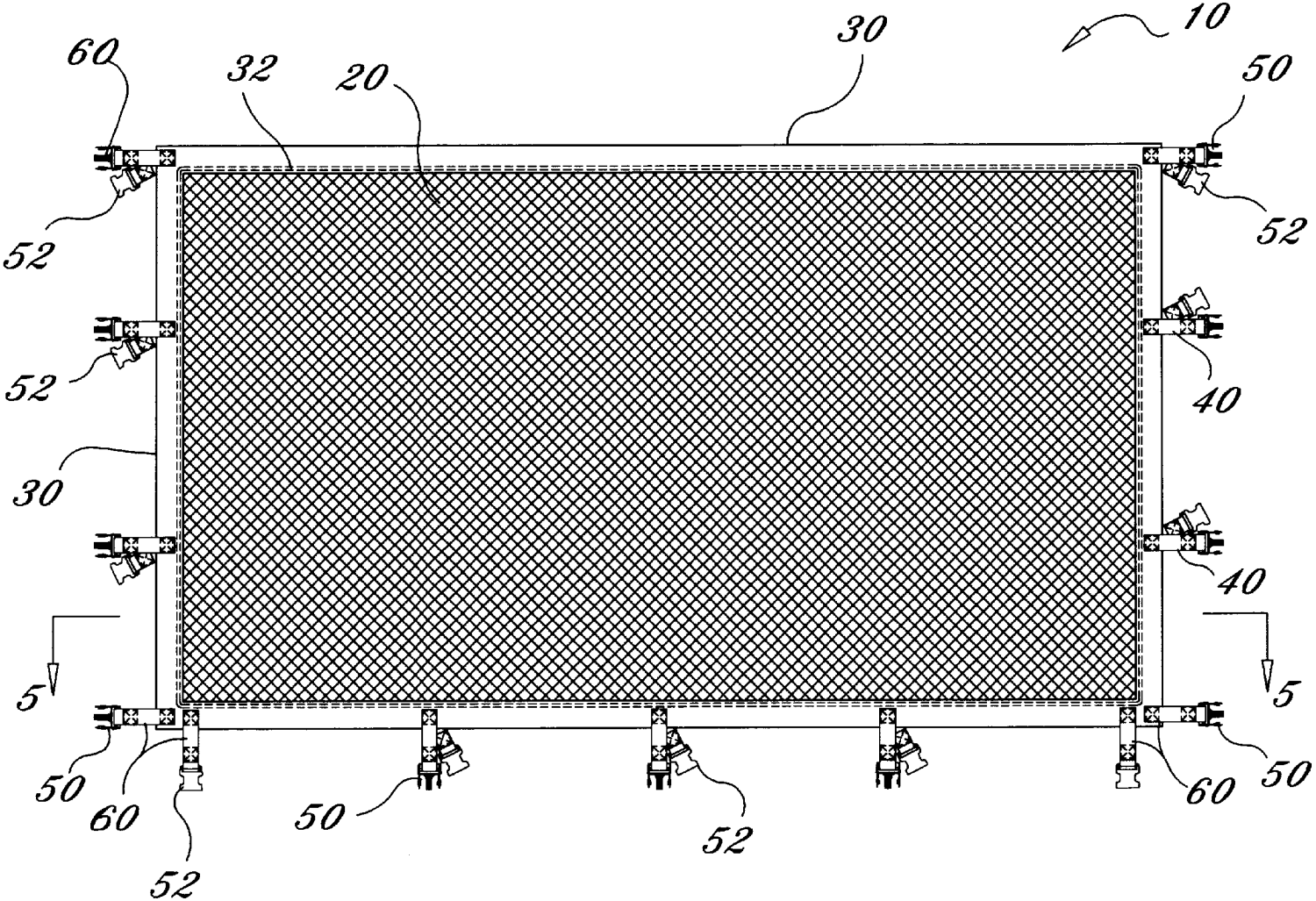
FIG. 1 is a top view of the present invention.

Turning now descriptively to the drawings, in which similar reference characters denote similar elements throughout the several views, FIGS. 1 through 5 illustrate a boatlift storage net 10, which comprises a support member 20 comprised of a netting material, a perimeter support 30 secured about the outer perimeter of the support member 20, a pair of comer straps 60 secured to opposing comers of the perimeter support 30, a plurality of side straps 40 secured to the perimeter support 30 on three sides, and a plurality of male fasteners 50 and female fasteners 52 secured to the side straps 40 and the comer straps 60. The side straps 40 are positioned about the side members 17 of a canopy frame 16 while the comer straps 60 are secured about the comer arced members 19 within the front end of the boatlift 12. Various items may be positioned upon the support member 20 out of view and protected from the elements of weather.

As shown in FIG. 1 of the drawings, a conventional boatlift 12 has a plurality of support poles 14 that support the canopy frame 16. The canopy frame 16 is comprised of four side members 17 that form a rectangular structure and a plurality of arced members 19 that are attached to two opposing side members 17 traversely to a longitudinal axis of the canopy frame 16. A cover 18 is attached about the canopy frame 16 for protecting the boat from the weather elements.

Figure 2:
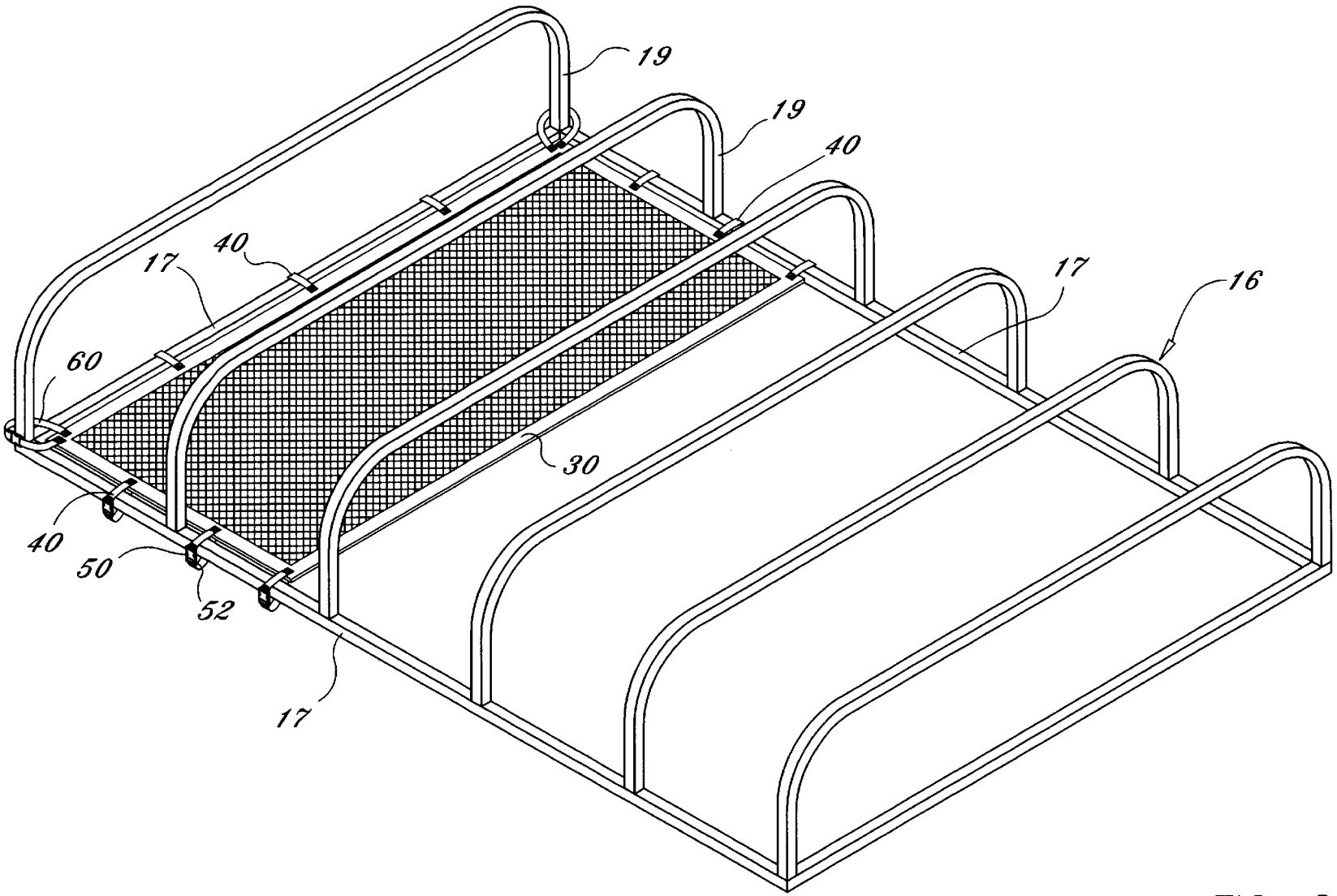
FIG. 2 is an upper perspective view of the present invention attached to a canopy frame of a boatlift.
Figure 3:
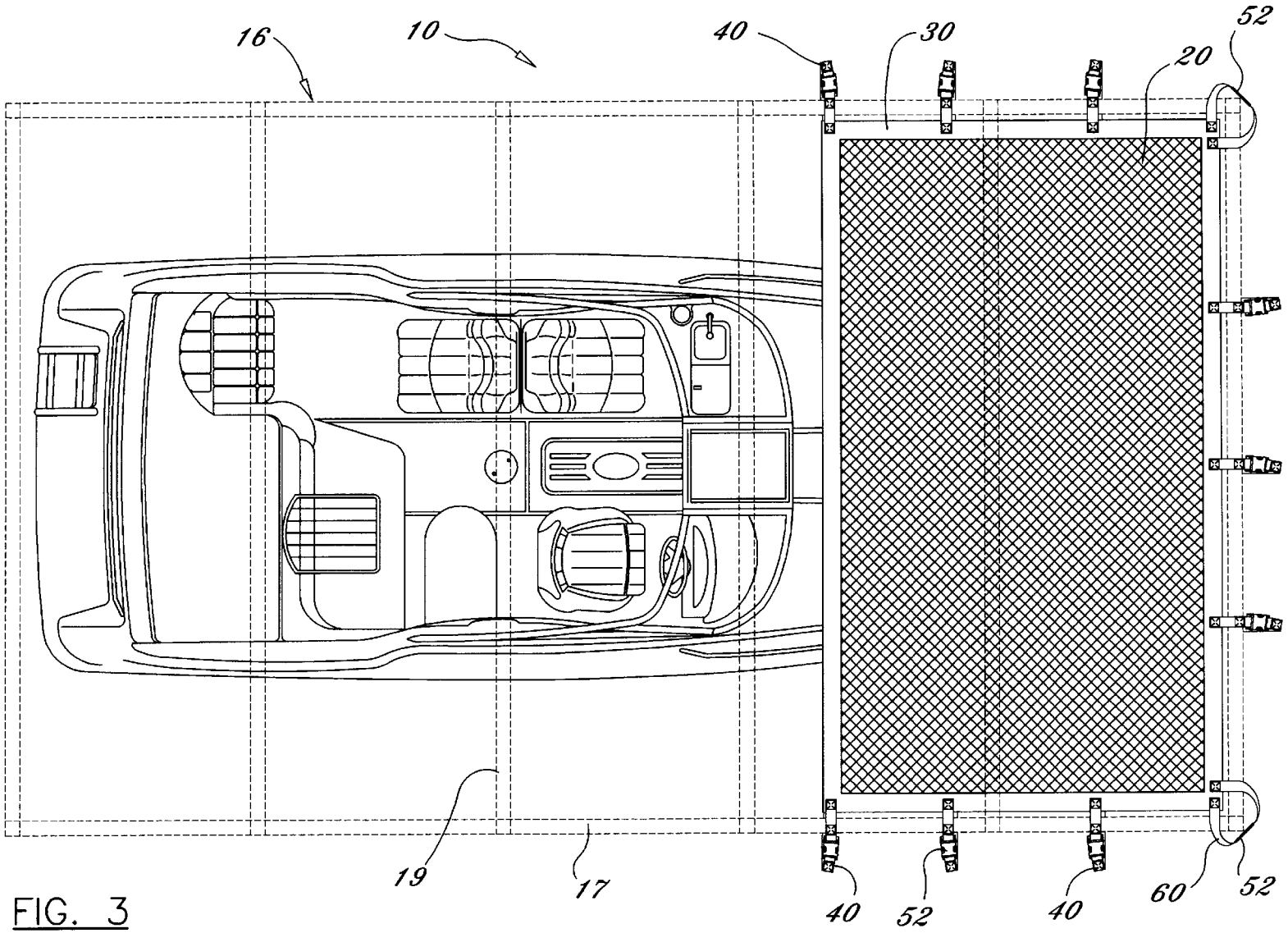
FIG. 3 is a top view of the present invention attached to a canopy frame of a boatlift.
Figure 4:
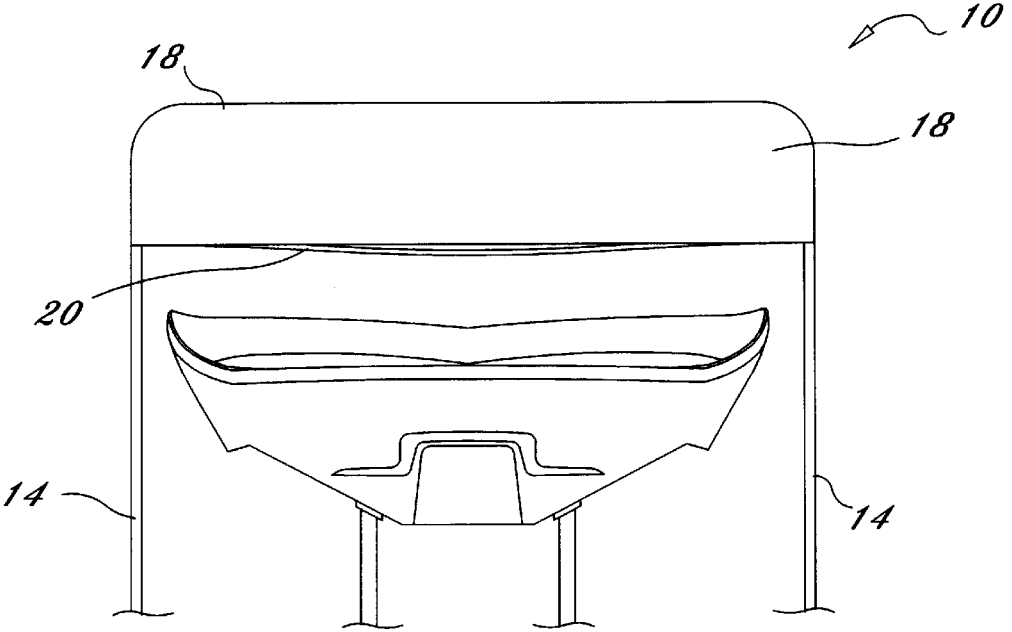
FIG. 4 is a rear view of the present invention attached to a canopy frame of a boatlift.

As shown in FIGS. 1 through 3 of the drawings, the support member 20 is formed to fit within the front portion of the canopy frame 16. The support member 20 has a rectangular shape as best shown in FIGS. 1 and 3 of the drawings. The support member 20 is preferably constructed of a perforated material such as netting to allow accumulated water within the items being stored to dissipate.

Figure 5:
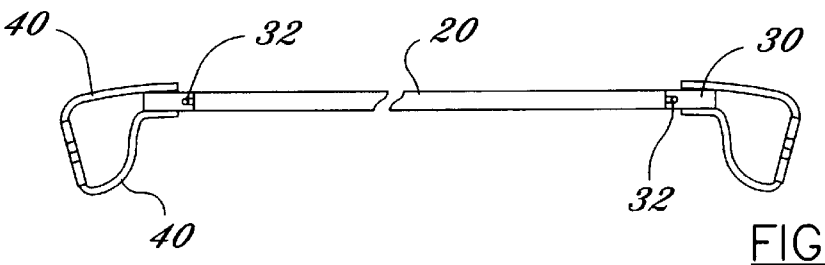
FIG. 5 is a cross sectional view taken along line 5—5 of FIG. 1.

As shown in FIGS. 1 through 3 of the drawings, a perimeter support 30 is secured to the outer perimeter of the support member 20. As shown in FIG. 5, the perimeter support 30 preferably includes a length of cord 32 to increase the strength of the perimeter support 30.

As further shown in FIGS. 1 through 3 of the drawings, a plurality of first straps are secured to three sides of the perimeter support 30 with no first straps secured to the rear side of the perimeter support 30. The plurality of first straps are secured to the perimeter support 30 in pairs as best shown in FIG. 1 of the drawings. Each pair of first straps are secured to opposing sides of the perimeter support 30 and are extendable about the side member 17 of the canopy frame 16.

As shown in FIGS. 1 through 3 of the drawings, each pair of first straps includes a male fastener 50 and a female fastener 52 for allowing quick attachment and removal of the first straps from the side members 17. The male fastener 50 is easily inserted into the female fastener 52 as shown in FIG. 3 of the drawings. To release the fasteners 50, 52, the user simply squeezes the sides of the male fastener 50 thereby allowing the male fastener 50 to be removed from the female fastener 52.

As shown in FIGS. 1 through 3 of the drawings, two sets of corner straps 60 are secured to opposing corners of the perimeter support 30 opposite of the rear side of the perimeter support 30. The corner straps 60 are designed to be positioned about the arced member 19 secured to the comer of the canopy frame 16. The comer straps 60 are secured to the same side of the perimeter support 30 as shown in FIGS. 1 and 3 of the drawings.

In use, the user secures the side straps 40 about the side members 17 of the canopy frame 16 as shown in FIGS. 2 and 3 of the drawings. The user inserts each male fastener 50 into the corresponding female fastener 52 until the perimeter support 30 and the support member 20 are secured taut between the side members 17 of the canopy frame 16. The user then secures the comer straps 60 about the arced member 19 as shown in FIG. 2 of the drawings. The user then positions items such as life jackets and skiing gear upon the support member 20. Water from the items is allowed to flow through the support member 20. Air is also allowed to flow through the support member 20 keeping the items ventilated for preventing the growth of mold.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boatlift storage net attachable to a front end of a canopy frame of a boatlift, comprising:

a support member having a plurality of openings within;

a perimeter support secured to a perimeter of said support member;

a plurality of side straps and a plurality of corner straps secured to said perimeter support; and a means for securing said side straps to one another and said corner straps to one another about a canopy frame.

2. The boatlift storage net of claim 1, wherein said support member is comprised of a netting material.

3. The boatlift storage net of claim 2, wherein said means for securing is comprised of a male fastener securable within a female fastener.

4. The boatlift storage net of claim 1, wherein said perimeter support includes a length of support cord.

5. The boatlift storage net of claim 4, wherein said support member is comprised of a netting material.

6. The boatlift storage net of claim 5, wherein said support member is rectangular shaped.

7. The boatlift storage net of claim 6, wherein said means for securing is comprised of a male fastener securable within a female fastener.

8. The boatlift storage net of claim 7, wherein said corner straps are secured to a first side of said support member.

9. The boatlift storage net of claim 8, wherein said side straps and said corner straps are comprised of a nylon material.

10. The boatlift storage net of claim 1, wherein said means for securing is comprised of a quick coupler structure.

11. A boatlift storage net attachable to a front end of a canopy frame of a boatlift, comprising:

a support member having a plurality of openings within, wherein said support member is rectangular shaped;

a perimeter support secured to a perimeter of said support member, wherein said perimeter support includes a pair of opposing front corners and a pair of opposing rear corners;

a plurality of side straps secured to a first side, a second side and a third side of said perimeter support;

a pair of corner straps secured to said pair of front corners of said perimeter support; and a means for securing said side straps to one another and said corner straps to one another about a canopy frame.

12. The boatlift storage net of claim 11, wherein said support member is comprised of a netting material.

13. The boatlift storage net of claim 12, wherein said means for securing is comprised of a male fastener securable within a female fastener.

14. The boatlift storage net of claim 11, wherein said perimeter support includes a length of support cord.

15. The boatlift storage net of claim 14, wherein said support member is comprised of a netting material.

16. The boatlift storage net of claim 15, wherein said means for securing is comprised of a male fastener securable within a female fastener.

17. The boatlift storage net of claim 16, wherein said corner straps are secured to a first side of said support member.

18. The boatlift storage net of claim 17, wherein said side straps and said corner straps are comprised of a nylon material.

19. The boatlift storage net of claim 11, wherein said means for securing is comprised of a quick coupler structure.

* * * * *